US008678916B2

(12) United States Patent
Cannon et al.

(10) Patent No.: US 8,678,916 B2
(45) Date of Patent: Mar. 25, 2014

(54) METHODS AND APPARATUS FOR PROVIDING TICKETS FROM GAMING DEVICES AND/OR LOTTERY TERMINALS

(71) Applicant: IGT, Reno, NV (US)

(72) Inventors: Lee E. Cannon, Bozeman, MT (US); Mike Maroney, Bozeman, MT (US); Robert Gunn, Henderson, NV (US); Mick D. Roemer, Las Vegas, NV (US); William R. Adams, Las Vegas, NV (US); Jason DeGrandmaison, Atlantic City, NJ (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/693,909

(22) Filed: Dec. 4, 2012

(65) Prior Publication Data

US 2013/0095904 A1 Apr. 18, 2013

Related U.S. Application Data

(63) Continuation of application No. 09/655,252, filed on Sep. 5, 2000, now Pat. No. 8,419,526, which is a continuation-in-part of application No. 09/157,993, filed on Sep. 22, 1998, now Pat. No. 6,113,098.

(51) Int. Cl.
*A63F 9/24* (2006.01)

(52) U.S. Cl.
USPC ..... 463/25

(58) Field of Classification Search
USPC ..... 463/25
See application file for complete search history.

(56) References Cited

U.S. PATENT DOCUMENTS

| | | | |
|---|---|---|---|
| 3,792,437 | A | 2/1974 | Blumenthal et al. |
| 4,124,109 | A | 11/1978 | Bissell et al. |
| 4,218,011 | A | 8/1980 | Simjian |
| 4,689,742 | A | 8/1987 | Troy et al. |
| 5,039,848 | A | 8/1991 | Stoken |
| 5,097,981 | A | 3/1992 | Degasperi et al. |
| 5,158,293 | A | 10/1992 | Mullins |
| 5,265,874 | A | 11/1993 | Dickinson et al. |
| 5,290,033 | A | 3/1994 | Bittner et al. |
| 5,348,299 | A | 9/1994 | Clapper, Jr. |
| 5,397,125 | A | 3/1995 | Adams |
| 5,408,417 | A | 4/1995 | Wilder |

(Continued)

FOREIGN PATENT DOCUMENTS

| | | |
|---|---|---|
| GB | 1559496 | 1/1980 |
| JP | 05-216606 | 8/1993 |

(Continued)

OTHER PUBLICATIONS

U.S. Nonfinal Office Action dated Jul. 31, 2002 issued in U.S. Appl. No. 09/655,251.

(Continued)

*Primary Examiner* — Corbett B Coburn
(74) *Attorney, Agent, or Firm* — Foley & Lardner LLP

(57) ABSTRACT

Gaming devices dispense tickets which are unrelated to a player's success on a particular game played on a gaming device or to the player's credits on a credit meter or other "cash out" indicator. The gaming devices provide gaming awards, and also provide tickets. Other methods provide tickets during the play of wagering games. Still other embodiments comprise lottery terminals which dispense tickets other than those purchased by a lottery patron or won on a purchased lottery ticket.

12 Claims, 6 Drawing Sheets

(56) References Cited

U.S. PATENT DOCUMENTS

| | | | |
|---|---|---|---|
| 5,487,544 | A | 1/1996 | Clapper, Jr. |
| 5,489,096 | A | 2/1996 | Aron |
| 5,502,636 | A | 3/1996 | Clarke |
| 5,609,337 | A | 3/1997 | Clapper, Jr. |
| 5,613,679 | A | 3/1997 | Casa et al. |
| 5,619,649 | A | 4/1997 | Kovnat et al. |
| 5,621,812 | A | 4/1997 | Deaton et al. |
| 5,628,684 | A | 5/1997 | Bouedec |
| 5,642,485 | A | 6/1997 | Deaton et al. |
| 5,645,485 | A | 7/1997 | Clapper, Jr. |
| 5,647,592 | A | 7/1997 | Gerow |
| 5,709,603 | A | 1/1998 | Kaye |
| 5,722,890 | A | 3/1998 | Libby et al. |
| 5,749,784 | A | 5/1998 | Clapper, Jr. |
| 5,761,647 | A | 6/1998 | Boushy |
| 5,785,594 | A | 7/1998 | Seibert et al. |
| 5,788,573 | A | 8/1998 | Baerlocher et al. |
| 5,816,918 | A | 10/1998 | Kelly et al. |
| 5,833,540 | A | 11/1998 | Miodunski et al. |
| 5,928,082 | A | 7/1999 | Clapper, Jr. |
| 5,934,671 | A | 8/1999 | Harrison |
| 5,941,773 | A | 8/1999 | Harlick |
| 6,048,269 | A | 4/2000 | Burns et al. |
| 6,113,098 | A | 9/2000 | Adams |
| 6,193,608 | B1 | 2/2001 | Walker et al. |
| 6,267,671 | B1 | 7/2001 | Hogan |
| 6,312,332 | B1 | 11/2001 | Walker et al. |
| 6,585,589 | B2 | 7/2003 | Okuniewicz |
| 6,913,534 | B2 | 7/2005 | DeFrees-Parrott et al. |
| 7,686,687 | B2 | 3/2010 | Cannon et al. |
| 8,070,590 | B2 | 12/2011 | Cannon et al. |

FOREIGN PATENT DOCUMENTS

| | | |
|---|---|---|
| JP | 07-037228 | 7/1995 |
| JP | 60-128850 | 8/1995 |
| JP | 08-103549 | 4/1996 |
| WO | WO02/21467 | 3/2002 |

OTHER PUBLICATIONS

U.S. Final Office Action dated Jul. 9, 2003 issued in U.S. Appl. No. 10/353,689.
U.S. Nonfinal Office Action dated Apr. 19, 2004 issued in U.S. Appl. No. 10/353,689.
U.S. Final Office Action dated Nov. 9, 2004 issued in U.S. Appl. No. 10/353,689.
U.S. Decision on Appeal dated Mar. 31, 2008 issued in U.S. Appl. No. 10/353,689.
U.S. Nonfinal Office Action dated Sep. 10, 2008 issued in U.S. Appl. No. 10/353,689.
U.S. Nonfinal Office Action dated May 20, 2002 issued in U.S. Appl. No. 09/655,252.
U.S. Final Office Action dated Jan. 15, 2003 issued in U.S. Appl. No. 09/655,252.
U.S. Final Office Action dated Aug. 15, 2003 issued in U.S. Appl. No. 09/655,252.
U.S. Nonfinal Office Action dated Mar. 9, 2004 issued in U.S. Appl. No. 09/655,252.
U.S. Final Office Action dated Nov. 22, 2004 issued in U.S. Appl. No. 09/655,252.
U.S. Notice of Allowance dated Jul. 10, 2009 issued in U.S. Appl. No. 10/353,689.
U.S. Office Action dated Feb. 1, 2010 issued in U.S. Appl. No. 12/131,859.
U.S. Office Action dated Feb. 25, 2010 issued in U.S. Appl. No. 12/247,694.
U.S. Final Office Action dated Jul. 26, 2010 issued in U.S. Appl. No. 12/131,859.
U.S. Final Office Action dated Apr. 1, 2011 issued in U.S Appl. No. 12/131,859.
U.S. Third-Party Submission dated May 25, 2012 in U.S. Appl. No. 13/309,408.
U.S. Notice of Allowance dated Oct. 28, 2009 issued in U.S. Appl. No. 10/353,669.
U.S. Notice of Allowance dated Aug. 1, 2011 issued in U.S. Appl. No. 12/131,859.
U.S. Notice of Allowance dated Sep. 7, 2012 issued in U.S. Appl. No. 09/655,252.
U.S. Board of Patent Appeals and Interferences Decision dated Jun. 26, 2012 issued in U.S. Appl. No. 09/655,252.
U.S. Order Remanding to Examiner dated Sep. 8, 2009 issued in U.S. Appl. No. 09/655,252.
U.S. Miscellaneous Communication re Appeal dated Mar. 6, 2009 issued in U.S. Appl. No. 09/655,252.
U.S. Notice of Allowance dated Jun. 22, 2012 issued in U.S. Appl. No. 13/309,408.
U.S. Notice of Allowance dated Oct. 1, 2012 issued in U.S. Appl. No. 13/309,408.
PCT/US2001/027462 International Preliminary Examination Report dated Jun. 12, 2003 issued in Application No. PCT/US2001/027462.
PCT/US2001/027462 Declaration of Non-Establishment of International Search Report dated Jun. 12, 2003 issued in Application No. PCT/US2001/027462.
AU Office Action dated Sep. 9, 2008 issued in Australian Application No. 2007216783.
AU Office Action dated Sep. 9, 2008 issued in Australian Application No. 2007216774.
AU Australian Office Action dated Sep. 9, 2008 issued in Australian Application No. 2007216776.
JP Office Action dated Apr. 14, 2009 issued in Japanese Application No. 2000-573822.
CA Office Action dated Oct. 19, 2009 issued in Application No. 2,421,566.
AU Examination Report dated Jan. 16, 2012 issued in Application No. 2010202405.
AU 2nd Examination Report dated Mar. 22, 2012 issued in Application No. 2010202405.
*Brandstetter et al.* v. *Bally Gaming, Inc. et al.*, Case No. A571641, Complaint filed Sep. 15, 2008.
*Brandstetter et al.* v. *Bally Gaming, Inc. et al.*, Case No. A571641, Defendants IGT, et al., Answer to Complaint, filed Oct. 15, 2008.
*Brandstetter et al.* v. *Bally Gaming Inc. et al.* Case No. A571641, Defendants Bally Gaming, Inc's Motion to Dismiss; Motion for More Definite Statement, filed Nov. 17, 2008.
*Brandstetter et al.* v. *Bally Gaming Inc. et al.*, Case No. A-571641C, Opposition to Bally Gaming, Inc.'s Motion to Dismiss; Motion for More Definite Statement, filed Nov. 25, 2008.
*Brandstetter et al.* v. *Bally Gaming Inc. et al.*., Case No. A571641, Opposition to Scott Boyd's Motion to Dismiss, filed Dec. 10, 2008.
*Brandstetter et al.* v. *Bally Gaming Inc. et al.*, Case No. A571641, Affidavit of Michael Longmeyer, filed Dec. 11, 2008.
*Brandstetter et al.* v. *Bally Gaming Inc. et al.*, Case No. A571641, Defendants IGT and Acres Gaming, Inc.'s Motion for Summary Judgment, filed Dec. 12, 2008.
*Brandstetter et al.* v. *Bally Gaming Inc. et al.*, Case No. A571641, Affidavit of Scott Boyd, filed Dec. 12, 2008.
*Brandstetter et al.* v. *Bally Gaming Inc. et al.*, Case No. A571641, Bally Gaming, Inc.'s Reply in Support of Motion to Dismiss and for More Definite Statement, filed Dec. 23, 2008.
*Brandstetter et al.* v. *Bally Gaming Inc. et al.*, Case No. A571641, Errata to Motion for Summary Judgment, filed Jan. 8, 2009.
*Brandstetter et al.* v. *Bally Gaming Inc. et al.*, Case No. A571641, Opposition to Defendants' IGT and Acres Gaming, Inc.'s Motion for Summary Judgment, filed Jan. 9, 2009.
*Brandstetter et al.* v. *Bally Gaming Inc. et al.*, Case No. A571641, Reply to Plaintiffs' Opposition to Defendants IGT and Acres Gaming, Inc.'s Motion for Summary Judgment, filed Jan. 13, 2009.
*Brandstetter et al.* v. *Bally Gaming Inc. et al.*, Case No. A571641, Supplemental Exhibit J to Reply to Plaintiffs' Opposition to Defendants IGT and Acres Gaming, Inc.'s Motion for Summary Judgment, filed Jan. 14, 2009.

(56) References Cited

OTHER PUBLICATIONS

*Brandstetter et al*. v. *Bally Gaming Inc. et al*., Case No. A571641, First Amended Complaint With Exhibit "A" filed Under Seal Pursuant to Court Order, filed Jan. 30, 2009.

*Brandstetter et al*. v. *Bally Gaming Inc. et al*., Case No. A571641, Defendant Bally's NRCP 16.1 Early Case Conference Report, dated Feb. 27, 2009.

*Brandstetter et al*. v. *Bally Gaming Inc. et al*., Case No. A571641, Defendants' Case Conference Report, dated Mar. 30, 2009.

*Brandstetter et al*. v *Bally Gaming Inc. et al*., Case No. A571641, Findings of Fact, Conclusions of Law & Judgment, filed Jun. 11, 2009.

Declaration of Ward Chilton dated Jun. 16, 2003, 2 pages, describing 1980's slot machines with side-mounted ticket dispensers.

Fey, Marshal, "Slot Machines, A Pictorial Hisotry of the First 100 Years," 1983 Liberty Belle Books, p. 162.

METHODS AND APPARATUS FOR PROVIDING TICKETS FROM GAMING DEVICES AND/OR LOTTERY TERMINALS

RELATED APPLICATION DATA

This application is a continuation of U.S. patent application Ser. No. 09/655,252, filed Sep. 5, 2000, now U.S. Pat. No. 8,419,526, issued Apr. 16,2013, which is a continuation-in-part of U.S. patent application Ser. No. 09/157,993 filed Sep. 22, 1998 and now U.S. Pat. No. 6,113,098, issued Sep. 5, 2000.

The present invention relates to methods and apparatus for providing tickets from games of chance, such as gaming devices and from lottery terminals.

BACKGROUND OF THE INVENTION

Gaming devices have been known which dispense winning awards in various forms. For example, it has been known to dispense winning prizes if a randomly determined outcome is one of a preselected plurality of winning outcomes from a greater plurality of possible outcomes. Such awards have been provided to players in the form of coins, currency, credits or tickets redeemable for prizes.

The assignee of the present invention owns U.S. Pat. No. 5,397,125 entitled GAMING DEVICE WITH PAYOUTS OF MULTIPLE FORMS wherein winning players are provided with the opportunity of receiving payouts in at least two distinct forms, both of which are inherently valuable. For example, according to one embodiment, a first payout comprises a national currency while another form of payout comprises tokens formed of a precious metal such as silver or gold. It has also been previously disclosed to dispense winning payouts consisting of either checks in a form redeemable at a bank or other "redeemable tickets," i.e., tickets which are redeemable for prizes at a gaming establishment.

It is believed that all of the prior art which dispenses various forms of awards provided those awards only if a player had won a game on the gaming device.

SUMMARY OF THE INVENTION

In one aspect, the invention is directed to a gaming device that may include a currency receiver being adapted to receive at least one medium of currency and a display device being adapted to display indicia corresponding to an outcome of a wagering game. The outcome of an occurrence of the wagering game may be at least partially randomly determined, and a player of the gaming device may be provided with a gaming award based on the occurrence of a predetermined outcome during the occurrence of the wagering game after depositing at least a minimum amount of the at least one medium of currency in the currency receiver. The gaming device may further include a first output device being adapted to dispense a ticket after the occurrence of a triggering event, wherein the triggering event may not be the occurrence of a predetermined outcome of the wagering game wherein the player is provided with a gaming award, and the triggering event may not be every occurrence of the wagering game.

In another aspect, the invention is directed to a method of conducting a wagering game of chance that may include the steps of providing a player with an opportunity to place a wager, providing a gaming unit for playing a wagering game, wherein the outcome of an occurrence of the wagering game may be at least partially randomly determined, and providing the player of the gaming device with a gaming award based on the occurrence of a predetermined outcome during the occurrence of the wagering game. The method may further include dispensing a ticket to the player after the occurrence of a triggering event, wherein the triggering event may not be the occurrence of a predetermine4 outcome of the wagering game wherein the player is provided with a gaming award, and wherein the triggering event may not be every occurrence of the wagering game.

In a further aspect, the invention is directed to a method of conducting a wagering game on an electronic gaming device that may include the steps of providing a player with an opportunity to place a wager and to play the wagering game at the wagering device, wherein the outcome of each occurrence of the wagering game may be at least partially randomly determined, accumulating comp points for the player as the player plays the' wagering game, displaying a visible indication of the player's accumulated comp points at the gaming device, and providing the player with the opportunity to redeem at least a portion of the accumulated comp points at the gaming device via an input device.

Additional aspects of the invention are defined by the claims of this patent.

The present invention comprises various embodiments of gaming devices which dispense tickets which are supplemental to, unrelated to, and/or other than the gaming award. As used herein, the term "gaming award" is used to indicate an award provided to a player based upon the outcome of a game played on a gaming device or table game which is determined, at least in part, by some randomly determined gaming event. The gaming devices of the present invention provide gaming awards, typically in a form selected from the group consisting of coins, currency, credits or "redeemable tickets" in response to a randomly determined event, and also provide supplemental, and/or unrelated other "tickets". As used herein, the term "tickets," is used broadly to indicate printed and/or electronically encoded matter which may not have any inherent value such as an advertisement or announcement, however, it may be redeemable for services, currency, discounts or other goods of value. The tickets of the present invention are actually dispensed, that is, some physical form is actually provided to a player. Additionally, according to some embodiments of the present invention, the tickets are actually printed, either in whole or in part, at the gaming device. The ticket dispensers and/or printers can be located internal to the housing of the gaming device or on the exterior gaming device. As used herein, the term "coins" includes national currency and tokens, whether formed of a precious metal or some other material. The term "gaming establishment" includes casinos and other places where gaming is conducted.

According to some embodiments of the present invention, gaming devices are provided which randomly determine some outcome and then provide a gaming award when preselected winning outcomes are determined, and also comprise means for dispensing tickets independently of those preselected winning outcomes. For example, a gaming device is provided with a random number generator which is used to randomly determine the outcome, e.g., final reel display on a reel slot machine, but the tickets are dispensed independently of the particular outcome. The random number generator or other random event determining device is typically located within the housing of a gaming device; however, in the case of distributed gaming, one or more random number generators may be located in a host computer which is linked to a plurality of gaming terminals.

According to still further embodiments, tickets are dispensed according to criteria which include one or more particular outcomes of a random event determining device.

The dispensing and/or printing of the tickets can also be effected by criteria other than the random event determining device, for example, only at various times or depending upon some other criteria, such as rate of play, length of play, or amount wagered and/or may be in addition to one or more particular gaming awards.

Still further embodiments of the present invention comprise at least one random number generator for determining the outcome of a wagering game and a different random number generator for controlling one or more aspects of the dispensing of tickets. In this case, either random number generator can be located within the housing of the gaming device or at some remote location which is linked to the gaming device.

Other embodiments of the present invention relate to methods of conducting games of chance wherein tickets to a future drawing are provided. As used herein, the term "drawing" is meant broadly to include lotteries, sweepstakes, and other random selections, wherein one or more winning indicia are randomly selected from a plurality of such indicia. Other methods comprise providing tickets for play on that game or another game in conjunction with the tickets to a drawing.

Other embodiments of the present invention comprise methods of conducting wagering games comprising dispensing tickets which are redeemable for credits in a future game only after a predetermined period of time.

Other embodiments of the present invention comprise lottery terminals which dispense tickets other than the purchased tickets and based on criteria unrelated to the lottery patron's success from a purchased ticket.

These and other embodiments are described below.

DETAILED DESCRIPTION

Some embodiments of the present invention relate to gaming devices comprising ticket dispensers which dispense tickets in addition to and/or independent of the gaming award typically provided by the gaming device when a winning outcome is randomly selected from a plurality of possible outcomes. Other embodiments dispense tickets based on criteria unrelated to randomly selected outcome.

Figure 1:
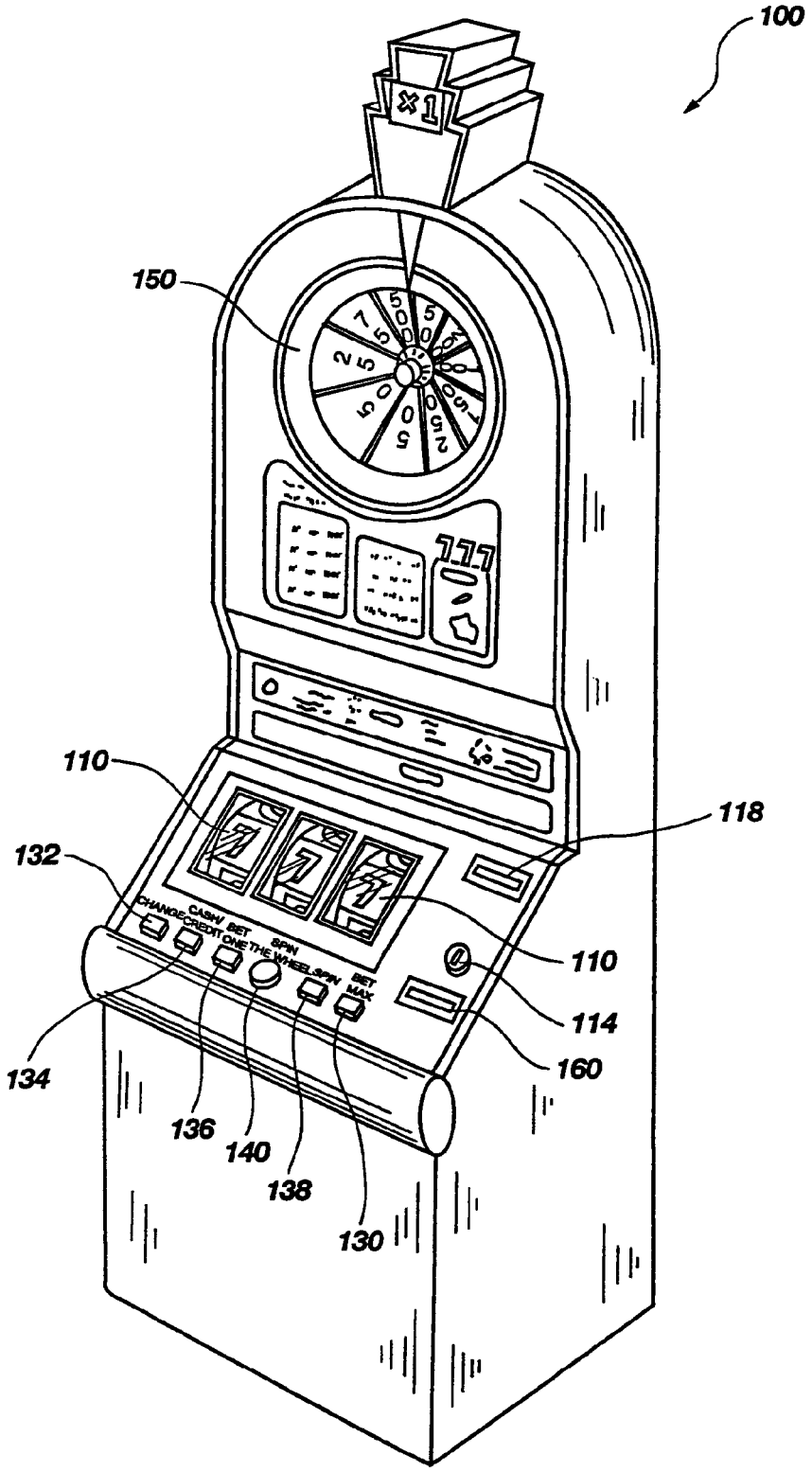
FIG. 1 illustrates one embodiment of the present invention on a reel slot machine.

One preferred embodiment of the present invention is illustrated in FIG. 1 wherein a gaming device 100 comprises a primary gaming unit in the form of a standard 3- reel slot machine with display reels 110. Suitable controls and currency mechanisms including a coin slot 114, bill validator 118, and ticket dispenser 160 are provided. Furthermore, suitable player controls including CHANGE button 132, CASH/CREDIT button 134, BET ONE button 136, SPIN button 138 and BET MAX button 130 are also provided.

Figure 2:
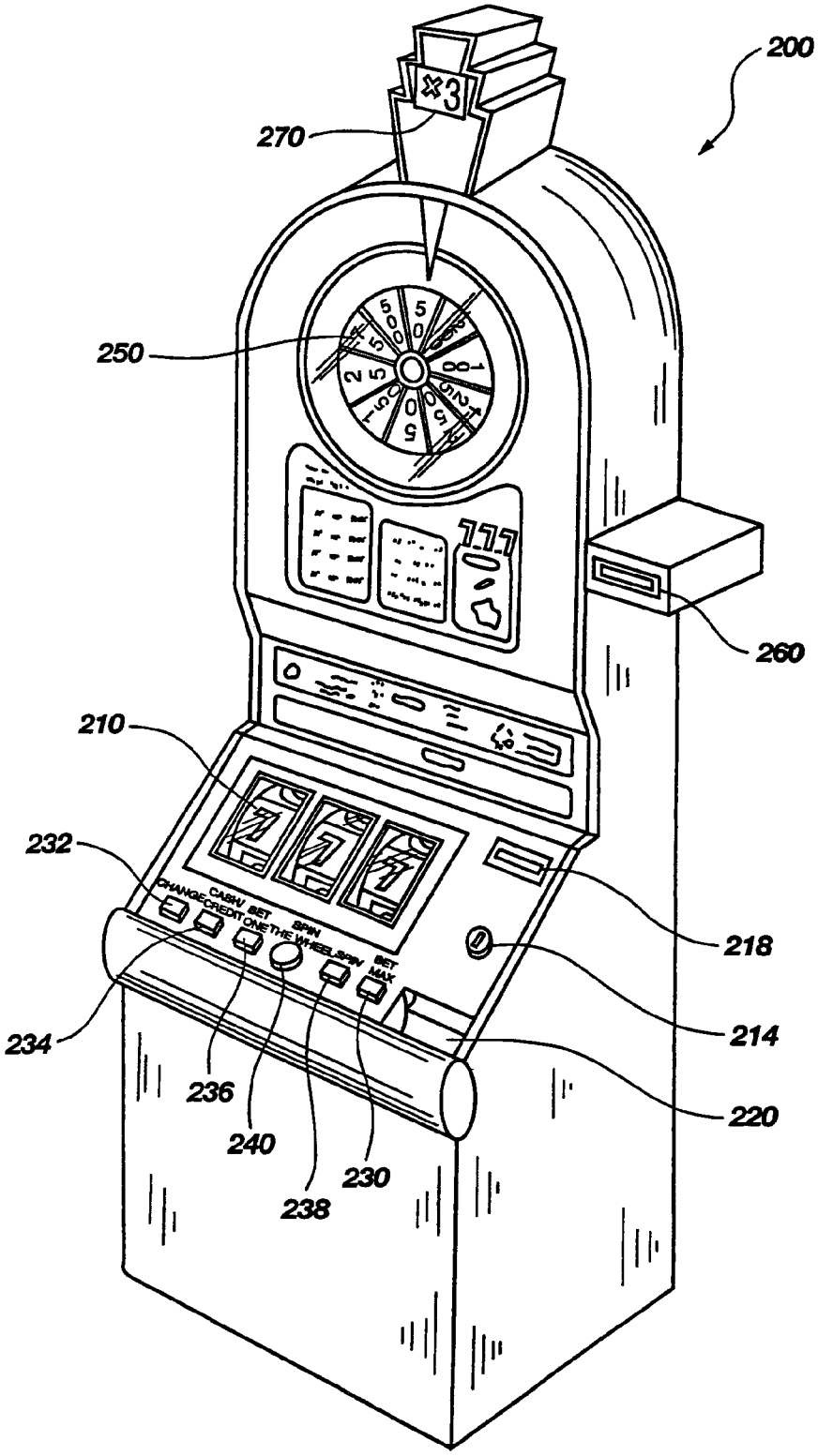
FIG. 2 illustrates a second embodiment of the present invention on a video slot machine.

In a similar video-display gaming device 200 illustrated in FIG. 2, the primary reels are illustrated on a video display 210 and a secondary event in the form of a video display of a rotatable reel 250 is provided. Furthermore, the outcome of the secondary gaming unit can be increased by a multiplier 270. In a manner similar to the embodiment illustrated in FIG. 1, suitable controls and currency mechanisms including a coin slot 214, bill validator 218, and a payout chute 220 are provided. Furthermore, suitable player controls including CHANGE button 232, CASH/CREDIT button 234, BET ONE button 236, SPIN button 238 and BET MAX button 230 are also provided. Additionally, an external ticket dispenser 260 is provided. As indicated in these figures, the supplemental ticket dispenser can be, but is not necessarily, separate and distinct from the portion of the gaming device which provides the gaming awards.

Figure 3:
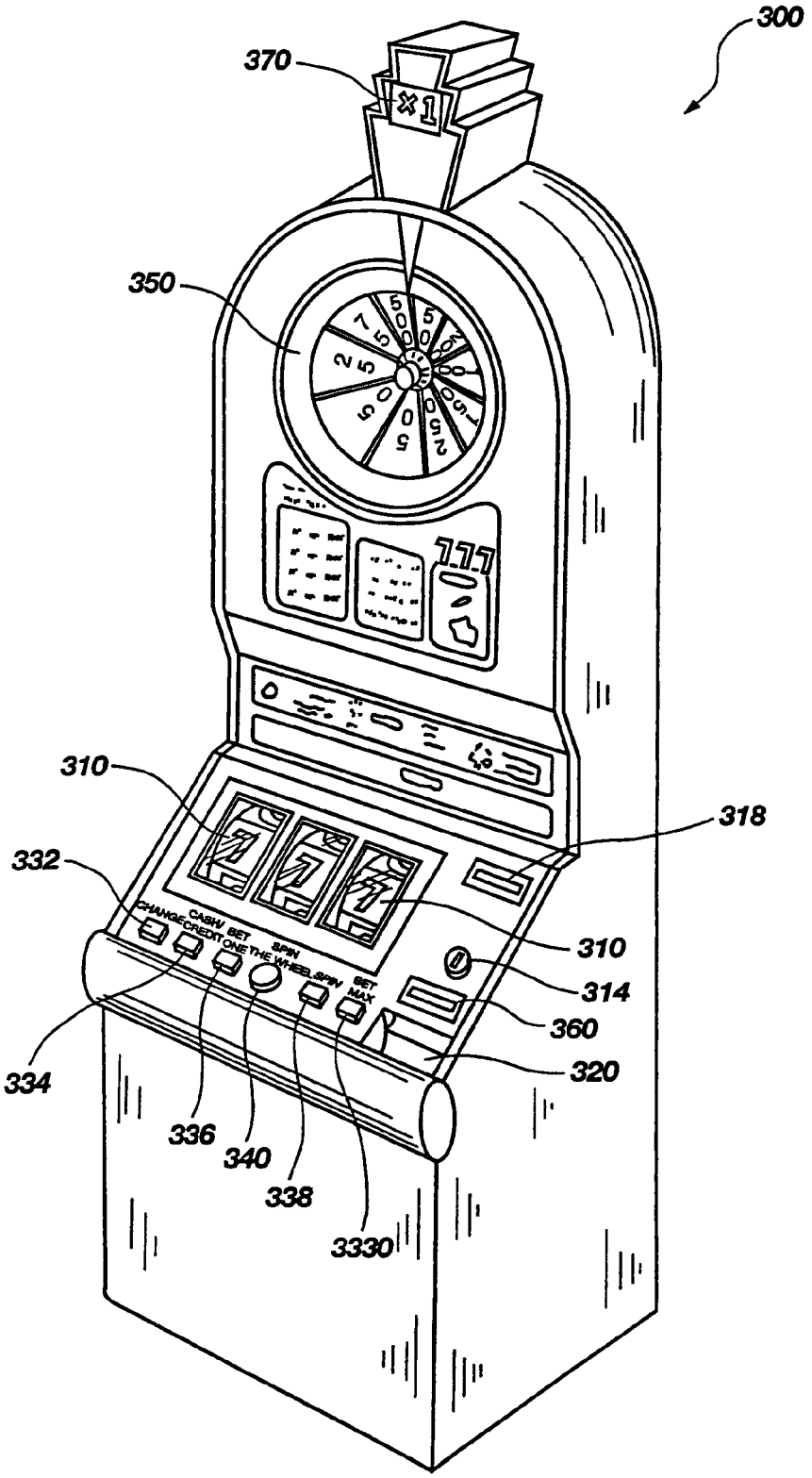
FIG. 3 illustrates another embodiment of the present invention on a reel slot machine.

A still further embodiment 300 of the present invention is shown in FIG. 3 wherein a ticket dispenser blank 360 is provided separately from a payout chute 320 which provides at least some of the gaming awards.

One preferred embodiment of the present invention comprises a gaming device which is coinless, i.e., which does not dispense coins. Instead, the gaming device prints a cash voucher of the credit balance when a player cashes out. The tickets of this embodiment of the present invention are preferably and advantageously printed by the same printer that prints the cash vouchers. Those skilled in the art will appreciate that gaming awards are typically provided or indicated in the form of coins, currency, credits or redeemable tickets in response to a randomly determined outcome by the gaming device.

According to another embodiment of the present invention, a gaming device is provided with a ticket dispenser which dispenses advertisements. For example, advertisements for a product or service unrelated to the gaming establishment can be provided. Additionally, either goods or services typically provided by the gaming establishment can be advertised or the ticket can be in the form of a coupon redeemable for such goods or services, such as free meals, a free room, a show, or credits on the gaming device which dispensed the ticket, or credits on another game. The credits can be real credits or promotional credits, wherein real credits can be cashed out for cash while promotional credits can only be used to play a game and cannot be cashed out. From the present description, those skilled in the art will appreciate that the ticket dispensers of the present invention can be utilized to introduce players to new games at the gaming establishment.

One embodiment of the present invention dispenses tickets in response to signals generated by the gaming establishment and/or to one or more signals input at a remote location such as at a control booth. For example, a gaming establishment or other game operator can program a host computer to dispense tickets automatically, with direct operator input or with indirect operator input. In the case of tickets dispensed automatically, a system is set up and tickets are subsequently dispensed without further operator input. In instances of tickets being dispensed with direct operator input, a specific signal is sent by an operator to a specific gaming device at a specific time. In the case of tickets dispensed with indirect operator input, after an operator provides input, for example at a host computer, some device performs some function which effects the identity of the ticket recipient, the timing that the ticket is dispensed, and/or the award or promotion reflected on the dispensed ticket. For example, a casino operator can decide to issue a prize, such as a television set, and make an announcement which is broadcast throughout the casino. The announcement can give patrons a time in which a voucher for that prize will be dispensed from certain gaming devices. The dispensing of tickets can be limited to a certain subset of gaming devices or by other criteria determined by the gaming establishment. At the predetermined time, a casino operator then issues the voucher for the prize according to the predetermined criteria.

Figure 5:
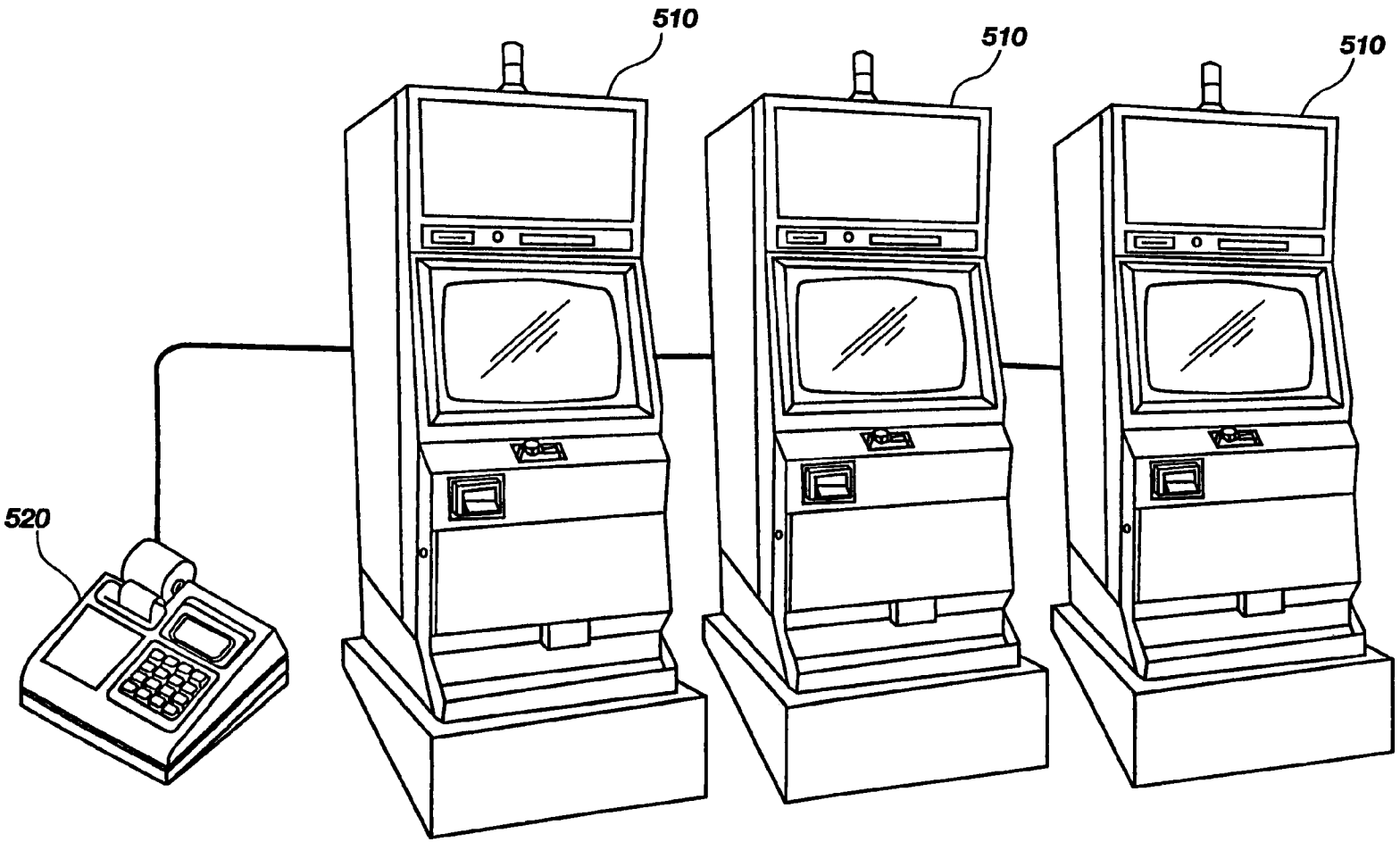
FIG. 5 illustrates a plurality of gaming devices linked to a host controller.

As shown in FIG. 5, a plurality of gaming devices 510 can be linked to a host computer-operated controller 520. In this manner, the dispensing of tickets in one or more of the manners described herein can be controlled and/or monitored by a host device 520 which is linked to a plurality of gaming devices.

According to another embodiment of the present invention, the ticket dispenser of the present invention will dispense tickets randomly throughout the day. According to one preferred embodiment, the random dispensing of tickets can require that the specific gaming device is being played; however, according to still another embodiment of the present invention, tickets are dispensed randomly throughout the day even if the particular gaming device from which the ticket is dispensed is not being played at that time.

According to still another embodiment of the present invention, tickets can be dispensed depending upon the outcome of another gaming device. For example, gaming devices within a certain area, such as those in close proximity to a first gaming device will dispense tickets if that first gaming device displays at least one of a plurality of possible outcomes. For example, if one gaming device provides a substantial prize, surrounding gaming devices can dispense consolation ticket~thereby adding to and expanding the merriment and excitement in that particular area of the gaming establishment.

According to another embodiment of the present invention, tickets will only be dispensed if the gaming device containing the ticket dispenser is being played at a certain minimum rate of play, e.g. four plays per minute. Thus, the rate of play can be a threshold criteria above which the player must play to qualify for a ticket, while the actual dispensing of the ticket will depend on another criteria, such as a timer, a random number generator, etc.

According to another embodiment of the present invention, tickets are only dispensed if a player has placed a player tracking card in the gaming device. The ticket dispensed in accordance with one preferred embodiment of the present invention is supplemental to any value previously associated with a player tracking card.

As noted above, the tickets can be promotional tickets which do not have any inherent or redeemable value other than to provide information relating to a product or service which is available either at the gaming establishment or elsewhere. Preferably, however, the tickets are redeemable for some product or service. For example, the ticket can be redeemable for credit(s) on the gaming device from which it was dispensed or at some other game(s). Additionally, the tickets can be redeemable for services provided by the gaming establishment. Furthermore, the tickets can be in the form of scratch-off tickets which when scratched off can provide monetary prizes, goods or services.

According to one preferred embodiment of the present invention, a gaming device prints a ticket which provides eligibility for a drawing as well as at least one free play after a predetermined time period. If the drawing is run with one or more numbers, the numbers can be chosen by the gaming device, by a host computer, or by a player through input controls such as a keypad or touch screen at the gaming device. The drawing can be conducted by the gaming establishment, by entry into a traditional government-run lottery, or through a third party drawing. Entry to the drawing can be exclusively via the gaming devices or may also be permitted by individuals through the purchase of drawing tickets, as in the case of a traditional government lottery. According to this embodiment of the present invention, the ticket is preferably coded, for example, with a secure random number which serves as entry into a drawing. For example, the drawing can be conducted by one or more gaming establishments at predetermined times, e.g., monthly. The dispensed ticket also advantageously provides a player with one or more credits on the gaming device which dispensed the ticket, on some other gaming device(s), or on a number of predetermined gaming devices. Advantageously, the drawing feature and the ability to obtain game credits utilizing one of these dispensed tickets only becomes valid after a predetermined time period. For example, a gaming device may dispense tickets during one particular week which provides a player with game credits or at some future time and eligibility in a drawing which is conducted at a different future time. Alternatively, the future game credits and the drawing eligibility can be at the same time. Therefore, the patron can return to the games which incorporate this feature some predetermined time after the ticket was dispensed, insert the ticket into the gaming device and receive notification of his/her status regarding the drawing as well as credits on the gaming device for one or more free plays. Awards won from one of the disclosed drawings can be paid directly to the player or can be issued as credits to the gaming machine, or some combination, for example, lower tier awards provided at the gaming device while higher tier cash prizes only pay directly to a player. This embodiment of the present invention encourages return play and customer loyalty and provides a player with at least one additional chance of winning even after the player ends his/her current play session. This embodiment of the present invention also permits a gaming establishment to offer a relatively large, lottery-styled jackpot to a player. The manner in which a player is notified of the drawing outcome can be accomplished visually, audibly, with a gaming device on a leader board, or at some location remote from the gaming device, but most preferably within a participating gaming establishment. The drawing status indication is most preferably provided to the player on the gaming device which also offers the player one or more free plays. In this manner, a player can be introduced to new gaming devices. The tickets of this embodiment of the present invention can also be provided with an expiration. Thereby, a player may be provided with a specific time window for obtaining entry into the drawing or for free play credit.

According to this preferred embodiment of the present invention, a player may not be guaranteed that the winning numbers drawn for any specific period will produce a winner from the group of tickets dispensed for that particular drawing. If there is no winner, the jackpot preferably rolls over into a subsequent drawing. For example, if the drawing is determined by randomly selecting a single number from the numbers 1-10,000 for a drawing during the first week of September, yet only 1500 tickets are dispensed containing entries to this particular drawing, then the winning number may not have been dispensed and the drawing will either end without a winner and/or the jackpot will be rolled over into the subsequent drawing, for example, a drawing during the second week of September. The tickets of the present invention will also preferably have a printed time period during which a winning drawing ticket must be redeemed. For example, for a drawing during the first week of September, a player may be required to redeem a winning ticket during the month of September. Any other time periods can be set as desired.

It is also within the scope of this aspect of the present invention to provide a player with game credits on a gaming device at the same times, different times, or overlapping times as the drawing feature. For example, for a drawing during the first week of September, a player can be provided with game credits on specified gaming devices during the first two weeks of September or during any time during the months of September or October, or alternatively only during the month of October. In the latter case, a player is encouraged to return to the particular gaming establishment during September to determine the player's status with respect to the drawing and again in October to receive free plays on the gaming device. Most preferably, the game credits become valid after the drawing in order to encourage a player to return to a gaming device. The free plays may simply be some number of credits which are either real or promotional. In the case of real credits, a player can cash out the credits for money while promotional credits may only be used for play on a gaming device and cannot be cashed out.

When the ticket provides credits on a gaming device, either the same gaming device which dispensed the ticket or a different gaming device, the gaming device on which the free credits are provided preferably comprises an electronic reader for reading the ticket. In this manner, a player can simply go to the gaming device at a valid time and insert the ticket to play a game.

According to this embodiment of the present invention, a gaming device is provided with suitable printers, controls and communication software in order to permit the desired control, monitoring and validation of dispensed tickets by the gaming establishment or other entity responsible for the supervision and/or control of the tickets. One preferred ticket of this embodiment of the present invention will include information indicating the valid time window for the free play credit and a number or numbers associated with a valid entry into the drawing and may also include promotional descriptions, disclaimers, expiration date, issue date, machine number, location identifier, and a bar code for validation purposes.

A somewhat simpler embodiment of the present invention comprises a gaming device and method for playing a game wherein the gaming device dispenses a drawing ticket comprising one or more sets of numbers or other indicia. According to this embodiment of the present invention, a drawing is held periodically and prizes are awarded to players holding winning tickets. The top prize of the drawing may be a fixed prize or a progressive prize based upon the total amounts wagered on participating gaming devices. This feature can also have time limits such as those discussed with other embodiments.

While various preferred embodiments of the present invention comprise dispensing tickets from gaming devices such as reel slot machines and video gaming devices, according to other embodiments of the present invention, tickets for drawings, game credits or free plays are dispensed during the play of wagering games commonly played on tables such as table card games, dice games, roulette, baccarat, etc. According to these embodiments of the present invention, the tickets can provide free credits or free plays on the game at which the ticket is dispensed or at some other game most preferably only becoming valid after some predetermined period of time. Alternatively and/or additionally, these tickets provide eligibility for a drawing.

Figure 4:
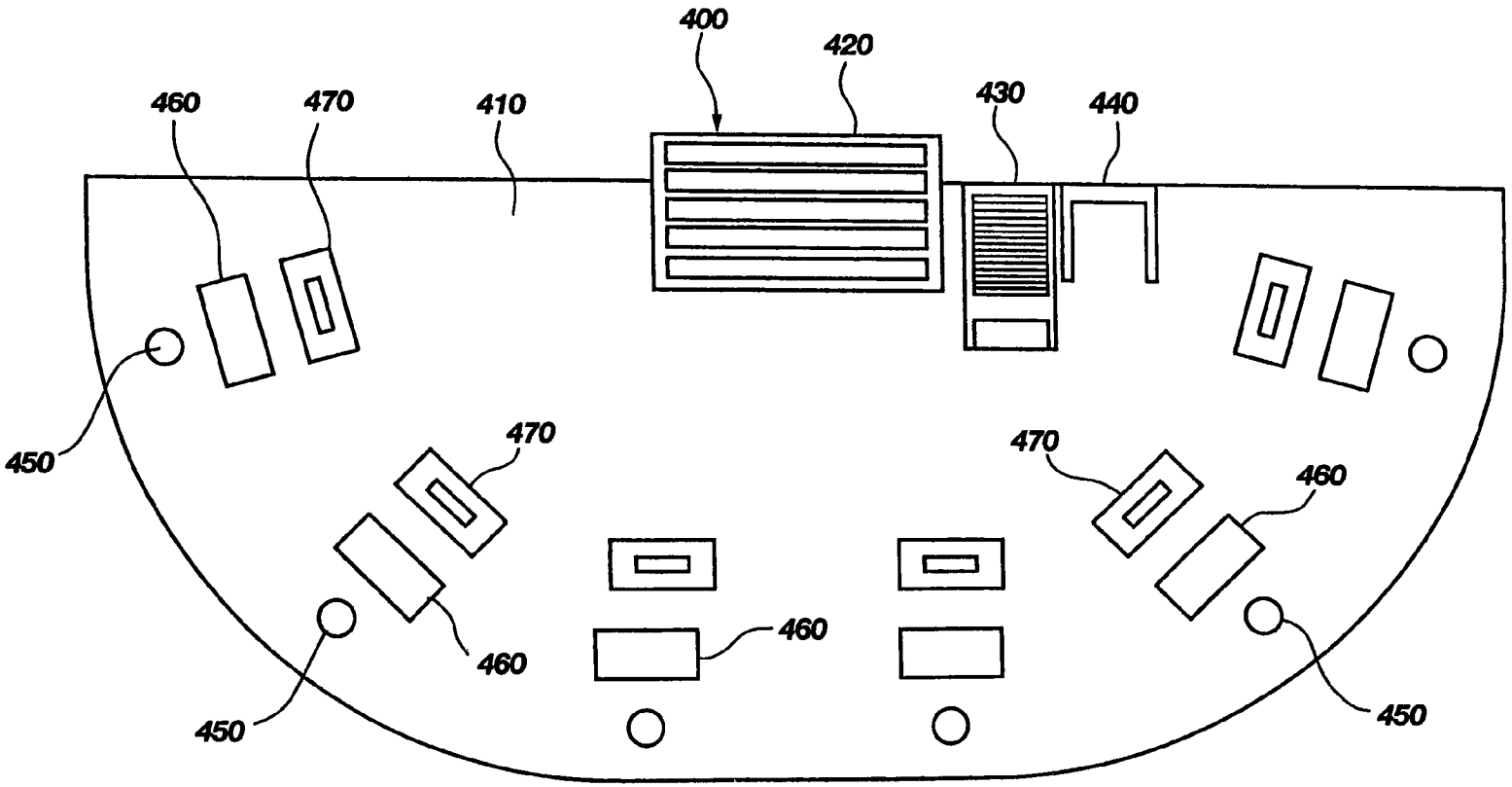
FIG. 4 illustrates an embodiment of the present invention on a table game.

Another embodiment of the present invention illustrated in FIG. 4 comprises a gaming table 400 which is provided with a playing surface 410, chip rack 420, card shoe 430 and discard tray 440. A plurality of player stations are located around the playing surface. While six stations are illustrated, it is within the scope of the present invention to provide more or fewer player stations. According to this embodiment of the present invention, each playing area comprises a wager area 450, a card area 460 and a ticket dispenser 470. According to this embodiment of the present invention, a ticket is dispensed at times or in manners described in accordance with the other embodiments.

According to a still further embodiment of the present invention, a gaming device issues a ticket which is not itself a drawing ticket but which is redeemable for a drawing ticket. According to this embodiment of the present invention, a player takes the dispensed ticket to either a booth wherein personnel issue the drawing ticket or to a central ticket dispenser which is capable of reading the ticket dispensed from the gaming device, confirming that the dispensed ticket is valid and then issuing a drawing ticket to the player.

Thus some embodiments of the present invention comprise providing tickets valid for free play, real credits or promotional credits on a gaming device after some predetermined period of time. As used herein, when a ticket is said to be redeemable or valid only "after some predetermined period of time," that length of time can be fixed in terms of hours, days, weeks, etc. or can simply be the length of time from the dispensing of the ticket to some future time or future event, e.g., a drawing. The free play or credits can be useful on the same gaming device which dispensed the tickets or at some other gaming device for promotional purposes, such as a new game which has recently been introduced.

All gaming devices and methods of the present invention can be used with coin games or with coinless games. In addition to the criteria above, the tickets of the present invention can also be dispensed after the play of a certain number of games on a particular gaming device. This feature can encourage players to continue playing, particularly if the number of players required in order to receive a free ticket is displayed to the player. Thus, tickets can be dispensed based upon the number of games played, the cash amount played, or some other similar play amount measurement. The tickets can also be dispensed by criteria which is time based, i.e., based upon the player's rate of play, or simply based on the cumulative time that a player has played. The present invention, therefore, is particularly attractive to gaming establishments which do not have an existing player tracking system since embodiments of the present invention can be implemented where a single gaming device itself tracks and rewards a qualified amount of play by a player.

According to another aspect of the present invention, a periodic random promotion by a gaming establishment can utilize tickets dispensed at a gaming device. According to this embodiment of the present invention, a player can receive tickets for a random promotion if the player meets certain play criteria, for example, wagering a predetermined amount during a certain period of time before the random promotion drawing. For example, if a player wages twenty dollars, the player can receive a number for a monthly drawing. By the time of the monthly drawing, a player can accumulate many tickets. This aspect of the present invention provides an easy way for a gaming establishment to dispense tickets while insuring that a player has met threshold criteria to qualify for the random promotion. The embodiments of the present invention which dispense drawing tickets are preferably of the quick-pick type, wherein the computer picks the numbers. However, it is also within the scope of the present invention to provide a player with the ability to select his or her own numbers utilizing controls at the gaming device, for example, a touch screen number selector or a key pad.

All gaming devices of the present invention can be provided with ticket printers, coin hoppers, or both.

Aspects of the present invention may or may not have a direct relation to the payout of the specific wagering game with which it is associated. As used herein, the term "gaming device" is used broadly to include all wagering games of chance, including but not limited to slot machines and table games, video games, such as video poker and video lottery gaming machines, coin games, coinless machines, and cashless machines.

Certain aspects of the present invention offer the advantages of significantly increasing the possible payout of a gaming device. For example, a gaming establishment can be provided with a number of nickel slot machines or other gaming devices. These gaming devices can be provided with ticket dispensers attached to or incorporated into the cabinets of the gaming devices. The ticket dispensers will dispense promotional scratch-off tickets to a player based on an event or string of events that are predetermined by the casino and controlled by another peripheral device, or by the casino's slot accounting/player tracking system. Some tickets may be redeemable for promotional items such as show tickets, dinners, rooms, etc. while other tickets may be valid for a large drawing such as a state lottery which provides a player with a chance to win many millions of dollars. According to this aspect of the present invention, a gaming establishment would incur the expense of the promotions, as well as the expense of the drawing tickets, which is typically less than one dollar per ticket. The gaming establishment can regulate the frequency with which the tickets are dispensed and thus the associated cost of the promotion. This aspect of the present invention allows a gaming establishment to offer a slot patron or other gaming device player a chance to win millions of dollars for just a single nickel bet. The denominations used are purely for illustration. From the present description, those skilled in the art will appreciate that different prizes can be provided without departing from the scope of the present invention.

According to a still further embodiment of the present invention, a player who is playing a gaming device can query his account for comp dollars and/or comp points in real time from the gaming device. Those skilled in the art will appreciate that player tracking systems typically distinguish between "comp points" wherein a player may receive, for example, ten points for each dollar wagered and "comp dollars" which are typically provided to players from a discretionary fund dispensed by a casino and which is accumulated based on the casino's theoretical hold of a particular game. With comp dollars, a player will typically receive more comp dollars per dollar wagered when playing on a gaming device which has a relatively low theoretical payout. Typically, gaming devices only show a player's comp points. If a player wishes to redeem comp points, the player must typically leave a gaming device and go to a club booth which then issues a voucher for goods or services e.g., a free dinner. In accordance with one aspect of the present invention, while a player is at a gaming device, the player can query his account in real time through the use of suitable controls. After suitable input from a player at a gaming device, which may comprise the input of a PIN number for security purposes, the gaming device will download information from a central player tracking system which provides an indication to the player at the gaming device of the player's comp points. The player tracking system can also send information regarding particular options that a player has and indicate those options to the player right at the gaming device. Therefore, if a gaming establishment is running low on a particular award, for example, a particular jacket which is normally available to patrons with sufficient comp points, this option can be automatically removed from the option list displayed to the player on the gaming device. This embodiment of the present invention provides a labor savings for the casino and provides a more convenient method for player redemption of comp points or comp dollars. Utilizing those same controls, a player can obtain a printout of a voucher for a free meal or can have the goods, for example, the jacket, delivered to the player's room or home address. This aspect of the present invention advantageously does not require a player to leave a gaming device in order to redeem "comp points" or "comp dollars." According to this aspect of the present invention, a gaming device is preferably placed in a "wait" mode with a predetermined timeout period so that the redemption of "comp points" or "comp dollars" can be completed during the short download period, preferably a matter of seconds, and internal checks can be performed to ensure the formatting requests to the ticket are within valid ranges. Once the ticket is successfully printed, an acknowledgment can be sent back to the player tracking system of the gaming establishment so that the card reader display can be updated with the appropriate message. At the same time, the gaming device can display a message indicating to the player that the "comp" issuance has been completed. Also, if the "comp" ticket is unreadable, a jam occurs, or some other problem occurs, a recall from the game can be performed showing the ticket payout history along with the "comp" amount and the player tracking card number for the casino operator. If a "comp" redemption is requested and the game is in the middle of play, or in a state where the "comp" redemption cannot be processed, an appropriate message is preferably displayed to the player and sent back to the player tracking system of the gaming establishment indicating an appropriate error code corresponding to the gaming device's current state.

Tickets of certain embodiments of the present invention can be comp tickets which are issued when commanded by a central host computer which is connected to a plurality of gaming devices or by the gaming devices themselves. Comp tickets can be issued after a predetermined amount of wagering has been completed or if a player has played a game for a predetermined amount of time. The dispensing of comp tickets may also be dependent upon the rate of play, the amounts wagered, the number of games played, or the length of continuous game play. The comp ticket could also be awarded when a specific game outcome occurs which may or may not be related to a winning outcome on the gaming device. Alternatively, a comp ticket can be awarded if a player experiences one or more losing streaks of some predetermined length in order to perk up a losing player. Still furthermore, a compensation ticket can be provided as a result of a random outcome which is only determined after certain qualifying game play. One or more of these methods for issuing "comp" tickets can be activated at the same time. For example, according to one embodiment of the present invention, a plurality of different methods for awarding "comp" tickets can be active and configured into a single gaming device. The particular award which is provided with a specific "comp" ticket can be determined separately with each of the criteria for awarding the "comp" ticket. Therefore, while a "comp" ticket can be awarded for one particular criteria, that ticket may have a different award value than a "comp" ticket awarded in response to a different "comp" ticket issuance criteria. Each "comp" ticket, preferably comprises an identifying number, a textual description of the "comp" awarded, and textual instructions as to how to redeem the "comp" ticket. If a "comp" ticket is displayed on a gaming device, the description preferably displays only the "comp" award and not the instructions. However, the "comp" ticket itself is preferably printed with the redemption instructions and the identifying number along with the description of the particular "comp" award.

According to the following example, if the "comp" ticket is to be awarded in response to accumulated play, a particular game outcome, a losing streak, or a random outcome for a particular qualifying game event, then the particular value of the "comp" ticket may determine when a "comp" ticket is awardable. On the other hand, the value of the particular "comp" ticket would not determine if the "comp" ticket is awardable for "comp" tickets issued by a host computer. In order to monitor the accumulation of "comp" points, a gaming device is preferably configured such that each of the "comp" criteria which can result in the dispensing of a "comp" ticket is provided with a meter which accumulates amounts earned towards a "comp" award. If the meter reaches the value of the associated "comp," the "comp" becomes awardable. Except for "comps" issued by a host computer, each meter will be incremented by some amount if certain specific conditions are met following each qualifying game played. A qualifying game, for example, is preferably one that meets the minimum bet requirements for a particular "comp" criteria. The minimum bet requirements can be specified either as a specific cash value or as requiring a MAX BET on the game. For each "comp" criteria, an increment size can be defined which determines the growth rate of the "comp" meter.

EXAMPLE

The following is an example of one method of issuing "comp" tickets according to different criteria which are described herein as "comp-type 0" through "comp-type 4" which are generally described as:

"Comp-type 0"—HOST TRIGGERED
"Comp-type 1"—ACCUMULATED PLAY
"Comp-type 2"—GAME TRIGGERED
"Comp-type 3"—LOSING STREAK
"Comp-type 4"—RANDOM OUTCOME In the case of "comp-type 0"—HOST TRIGGERED, the gaming establishment or other game operator designates which "comp" to award and specifies whether a ticket is issued from a gaming device immediately or after the next game is played. The casino controls will specify whether the command to issue a "comp" ticket should be ignored if the gaming device shows zero credits or whether the "comp" award should be queued up until there is a credit balance.

The issuance of "comp" awards according to "comp-type 1"—ACCUMULATED PLAY, provides a wide variety of tracking ability. In this example, time is broken up into periods of specified length. Internal metering is done on either the number of games played or on the amount wagered during a specific time period. To determine whether play is at a sufficient rate, a threshold is specified. If the metered amount for a prior period meets or exceeds the threshold, then the play rate is considered to be sufficient. For this "comp-type 1"—an accumulation meter can be incremented based upon the number of qualifying games played after sufficient play rate has been achieved or upon those games that were played in the period prior to achieving the play rate. In the former case, the accumulation can be based upon the increment size times either the number of games or the amount wagered. In the latter case, the accumulation can be based upon the increment size times either the number of periods that were rate sufficient or the value metered for the period (number of games or amount wagered). In addition, the accumulation meter can be configured to decrement or clear if there is a lack of rate-sufficient play. To accomplish this, a delay in terms of number of periods is specified. If this is set to zero, no decay/reset takes place. If this number of periods passes without any qualified game play, the meter begins decreasing by a specifiable reset decrement amount on each subsequent period. If the reset decrement amount is specified as zero, the accumulation meter is simply reset.

In the case of "comp-type 2"—GAME TRIGGERED, wherein the issuance of a "comp" ticket is triggered by some event during the normal play of the gaming device, the controls for dispensing a "comp" ticket are configured to identify which game and which award category within that game can trigger the incrementing of the corresponding accumulation meter. The incrementing can be based on either the number of games or upon the amount wagered. When the accumulation meter reaches the comp value, the "comp" ticket can be dispensed.

The "comp-type 3"—LOSING STREAK criteria need only be configured with the total number of qualifying games or the total amount wagered on qualifying games in a row without a winner to be considered a losing streak. A single losing streak preferably adds an increment to an accumulation meter and, therefore, each single losing streak does not necessarily result in the dispensing of a "comp" ticket. After the accumulation meter has reached the comp value, the comp ticket can be dispensed.

For the "comp-type 4"—RANDOM OUTCOME criteria, the gaming establishment need only specify an odds value 'n' that specifies that randomly, at an average of one in 'n' qualifying games, an accumulation meter will be incremented in accordance with a specific increment size. The increment size can be based upon the number of games or upon the amount wagered. When the accumulation meter reaches the comp value, the comp ticket can be dispensed.

Each "comp" type except "comp" type 0 (host triggered) has an accumulation meter for accumulating value towards a "comp". The value in the "comp" accumulation meter is compared to the "comp" value for a given type of "comp" ticket. If the "comp" accumulation meter is greater than or equal to the "comp" value for that specific ticket, then that "comp" ticket is awardable. In this example where there are multiple "comp" tickets corresponding to the different "comp" types, then the gaming device can be configured to allow continued accumulation until the player selects his "comp". Additionally, different prizes can be made available to a player based upon the amount of "comp" value accumulated. For example, one "comp" value may have one associated "comp" prize while more valuable prizes can be assigned higher "comp" values. In this case, a player may be provided with the option of continuing to accumulate "comp" value in order to qualify for higher-value prizes. The higher-value prizes become awardable when the accumulation meter reaches the corresponding "comp" value for any given prize. If accumulation is not enabled, the highest valued awardable "comp" is awarded.

This system also comprises a master meter which tracks the number of "comp" tickets awarded and the total value of those tickets. "Comp" tickets issued are also preferably logged into a cash-ticket log and into a game-play history log.

According to another embodiment of the present invention, a gaming system comprises multiple gaming devices wherein players can receive drawing tickets based upon certain game outcomes. At least one of the award categories causes the gaming machine to print a ticket which is valid in a drawing held periodically, e.g., weekly. The numbers or indicia can be selected by the gaming device in a quick-pick fashion or each gaming device can be provided with input apparatus for a player to choose his or her own numbers, for example, a touch screen or key pad. If a player is required to pick five or six numbers out of a large field of numbers, then prizes can be awarded for tickets with numbers matching three or more of the numbers drawn. The numbers may also be generated in a manner wherein they relate to the randomly determined outcome or some intermediate event of the wagering game. For example, if the game played on the gaming device comprises a spinning wheel or a Keno game, the number or numbers provided to the player may be the last number drawn on the wheel or Keno game. The drawing may also be non-numeric and can use any form of symbol. Matching all of the numbers or other symbols can provide the player with a progressive jackpot while other prizes are predetermined, fixed values. If the jackpot is not won, it preferably carries forward to the next drawing. If duplicate entry numbers are not allowed, a suitable number-generating algorithm can be used based upon the gaming device ID or upon a configured seed number provided to the gaming device, or the gaming devices can be linked such that no duplicate sets of numbers can be generated for a given drawing. If duplicate sets of numbers are permitted, then multiple winners would split the jackpot. A jackpot can be funded by the underlying same, e.g. with a percentage of the game play monies going to fund the drawing. In addition, lower tier prizes can be cash prizes or merchandise.

The tickets issued in accordance with the present invention which are issued dependent upon a player's amount wagered, length of continuous play, etc. can measure the qualifying player activity from the start of a particular play session or at regular intervals. In the case of a play session, the play session is preferably defined as the time when money/credit is added so the gaming device no longer has a zero/credit balance. The end of the play session is defined to be when the gaming device returns to a zero/credit balance by the player either playing off or cashing out the credit balance, and the machine staying at a zero/credit balance for a certain period of time, e.g., 30 seconds. This length of time can be adjusted by the gaming establishment through an administrative screen on a host computer. The main purpose of adding the time period option is to accommodate situations where the same player has run out of money and will replenish the game and continue playing. Without this feature, the game would assume the same player is a new player and would reset the accrual toward a ticket. For example, a gaming device can be set up to print a ticket when a total of $500.00 has been wagered during a single play session. Alternatively, a gaming device can dispense tickets at regular intervals. For example, a ticket can be issued every time a predefined dollar amount has been wagered. For example, if a ticket is to be issued every time a multiple of $500.00 has been wagered over the life of the machine, then a player can receive a ticket as soon as he starts playing if a previous player or players had wagered close to, but slightly less than, the$ 500.00 amount.

According to other embodiments of the present invention, tickets are dispensed from lottery terminals. The dispensed tickets are not related to the outcome on the tickets purchased in a standard fashion by a lottery player. In the case of lottery terminals, players can randomly receive tickets when they purchase a lottery ticket. The ticket received may be lottery related, for example, a free scratch ticket or a free daily pick-3 entry. Alternatively, the dispensed ticket could be some other promotion or prize. The various aspects of the present invention can be used with both on-line lottery tickets and two instant win tickets. Thus, the tickets of the present invention are in addition to tickets purchased by a lottery player and dispensed by a lottery terminal operator, and are unrelated to the outcome on the tickets purchased by the player. Nonetheless, in addition to the random distribution of tickets to lottery ticket purchasers, other criteria can be utilized for dispensing the tickets of the present invention from a lottery terminal. For example, a lottery player may be required to purchase three lottery tickets or to purchase lottery tickets of a predetermined value in order to qualify for the dispensing of these tickets. Upon qualifying, the tickets can be dispensed to qualifying lottery players either randomly or based upon some other criteria such as after a predetermined gross volume of purchases from either that particular lottery terminal, a predetermined group of lottery terminals or all lottery terminals on that particular system and/or in a geographic location. Furthermore, lottery players can be provided with an identification number or magnetically encoded card which can be swiped through or input into a lottery terminal. In this manner, a player's actual total purchases of lottery tickets within a given jurisdiction can be tracked and players can qualify for the tickets of the present invention based upon criteria such as total number of tickets purchased, total value of tickets purchased, frequency of play, frequency of playing different games, etc.

Figure 6:
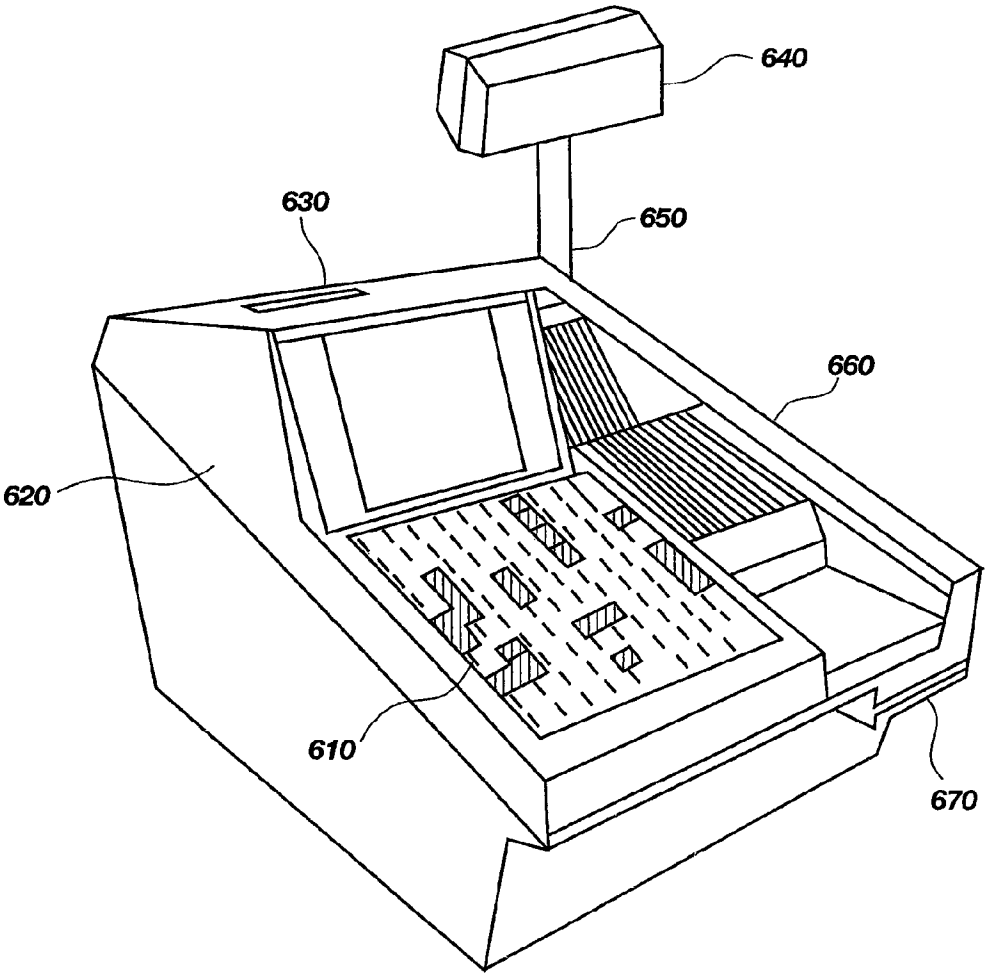
FIG. 6 illustrates an embodiment of the present invention on a lottery terminal.

FIG. 6 is an illustration of a lottery terminal which can be used in accordance with the scope of the present invention. The lottery terminal shown in FIG. 6 comprises a keyboard 610, a tiltable screen 620, ticket hopper 630, marketing display 640, bar code scanner 650, optical mark reader (OMR) 660 and magnetic strip reader 670.

The invention claimed is:

1. A gaming device comprising:

a currency receiver being adapted to receive at least one medium of currency;

a display device being adapted to display indicia corresponding to an outcome of a wagering game, the outcome of an occurrence of the wagering game being at least partially randomly determined, and an indication of a player' s accumulated comp points at the gaming device that are not gaming awards, wherein the comp points are determined independent of the outcome of the wagering game and skill of the player of the wagering game;

an input device adapted to receive the player's input for redeeming at least a portion of the accumulated comp points for redemption options; and an output device adapted to dispense vouchers for redemption options selected by the player upon redemption of accumulated comp points.

2. The gaming device according to claim 1 wherein the display device is adapted to display at least one redemption option to a player at the gaming device.

3. The gaming device according to claim 2 wherein the display device is adapted for changing the display of the at least one redemption option of the gaming device.

4. The gaming device according to claim 1 wherein the display device is adapted to display the player's accumulated comp points upon a required player input at the gaming device.

5. The gaming device according to claim 1 adapted to permit redemption of accumulated comp points upon a required player input at the gaming device.

6. The gaming device according to claim 1 wherein the output device is adapted to dispense a voucher redeemable for at least one of goods and services displayed on at least one redemption option selected by a player on the input device.

7. The gaming device according to claim 6 wherein the output device is adapted to print a voucher redeeming at least a portion of the accumulated comp points.

8. The gaming device according to claim 1 adapted to accumulate the comp points from a plurality of comp values according to different comp criteria.

9. The gaming device according to claim 8 wherein each of the plurality of comp values has corresponding comp awards.

10. The gaming device according to claim 9 wherein each comp value of the plurality of comp values has a different corresponding comp award.

11. The gaming device according to claim 8 adapted to continue to accumulate the comp points from a plurality of comp values according to different comp criteria after the player has reached a comp value level which qualifies for a comp award.

12. The gaming device of claim 1, wherein the output device is a first output device, and further comprising a second output device adapted to dispense a gaming award based on the occurrence of a predetermined winning outcome or cumulative result of a plurality of outcomes during the occurrence of the wagering game after depositing at least a minimum amount of at least one medium of currency in the currency receiver.

* * * * *